US007674185B2

(12) United States Patent
Omidi

(10) Patent No.: US 7,674,185 B2
(45) Date of Patent: Mar. 9, 2010

(54) TRAINING DEVICE FOR SWING DEVELOPMENT

(76) Inventor: Henry Omidi, 106-10744 Guildford Dr., Surrey, BC (CA) V3R 1W6

( * ) Notice: Subject to any disclaimer, the term of this patent is extended or adjusted under 35 U.S.C. 154(b) by 0 days.

(21) Appl. No.: 12/297,043

(22) PCT Filed: Apr. 13, 2006

(86) PCT No.: PCT/CA2006/000597

§ 371 (c)(1),
(2), (4) Date: Oct. 13, 2008

(87) PCT Pub. No.: WO2007/118298

PCT Pub. Date: Oct. 25, 2007

(65) Prior Publication Data

US 2009/0093319 A1 Apr. 9, 2009

(51) Int. Cl.
*A63B 69/36* (2006.01)

(52) U.S. Cl. ..... 473/219; 473/223; 473/295

(58) Field of Classification Search ..... 473/219, 473/223, 226, 229, 231, 294, 295, 296; 482/92, 482/93, 118

See application file for complete search history.

(56) References Cited

U.S. PATENT DOCUMENTS

| | | | | | |
|---|---|---|---|---|---|
| 5,106,095 | A * | 4/1992 | Pitkethly | 473/201 |
| 5,167,596 | A * | 12/1992 | Ferber | 482/46 |
| 5,282,776 | A * | 2/1994 | Dalebout | 482/118 |
| 5,374,225 | A * | 12/1994 | Wilkinson | 482/27 |
| 5,388,834 | A * | 2/1995 | Dawson | 473/211 |
| 5,401,022 | A * | 3/1995 | McCready | 473/294 |
| D460,132 | S * | 7/2002 | Asuncion et al. | D21/684 |
| 7,282,014 | B2 * | 10/2007 | Krietzman | 482/92 |
| 2006/0079341 | A1 * | 4/2006 | Mansour | 473/219 |

* cited by examiner

*Primary Examiner*—Nini Legesse
(74) *Attorney, Agent, or Firm*—C. Larry Kyle; Nexus Law Group LLP

(57) ABSTRACT

A training device 100 for swing development. A pair of telescoping rods 10 and 12 extend from a spring, one from either end. Each rod is connected to a coupling device 24, 26 having a rotating bearing to which are connected a pair of handles 4, 6. The handles 4, 6 extend perpendicularly to the telescoping rods 10, 12 and in opposite directions to one another. Various attachments can be connected to the handles 4, 6 to be rotated therewith; for example, representations of the sporting equipment to be swung such as a golf club 30 or racquet, or attachments to cause resistance to handle rotation or providing a periodic noise to work on swing rhythm.

4 Claims, 4 Drawing Sheets

TRAINING DEVICE FOR SWING DEVELOPMENT

FIELD OF THE INVENTION

The present invention relates to a training device for the development of proper swing technique. More particularly, the invention relates to a training device for teaching a user proper swing technique for a golf club and to help strengthen muscles used to swing a club.

BACKGROUND OF THE INVENTION

The popularity of golf as a recreational pastime has exploded over the years. Part of golf's appeal is that you do not need to be an athlete to take part in it, the most important part of golf being proper technique as opposed to overall strength or fitness level. New technologies have led to improvements to the equipment being used and increased discretionary spending has allowed greater numbers of individuals to take up the sport. However, technological advances to the clubs and balls can do little to correct for poor technique.

Lessons teaching proper swing technique are readily available at the golf courses themselves, however these are expensive and contingent on the teaching abilities of the teacher and on the student's ability to learn and practice. Learning and maintaining proper swing technique is essential to becoming a good player. Maintaining proper technique requires consistent practice in order to develop the required muscle memory that allows one to achieve consistent results.

Numerous golf training devices have been developed in order to allow a user to practice on their own time without having to pay a professional to assist them. For example, U.S. Pat. No. 3,985,364 issued to Brady teaches a golf training device comprising a flexible cord attached with VELCRO ® at one end to the golfer's glove and at the other end to the golfer's leg. The device is used to aid golfers in developing a proper swing and to overcome sway. According to the teachings of Brady, the VELCRO ® will pull apart providing an audible signal if the downswing is started correctly. While receiving an indication of the start of a proper downswing is helpful, the device does not provide any feedback with respect to the swing itself and whether the swing has followed a correct swing path.

Another golf training device is taught in U.S. Pat. No. 6,206,787 issued to Kleppen. Kleppen teaches a harness with a chest encircling band and shoulder straps, with a rigid bar attached transversely and retained in the rear portion of the shoulder straps. The device is used to teach the correct position at the peak of the back swing and at the end of the follow through. The device is limited to this use and does not address the remaining portions of the swing.

A further device for teaching a golfer how to swing properly is taught in U.S. Pat. No. 6,447,402 issued to Moran. Moran teaches a device comprising a rod connected perpendicularly to a yoke assembly for engaging and restraining the arms of a golfer. At the end of the rod is a coupler for attaching to the grip end of a club. The golfer places their arms through the yoke and grasps the grip of the golf club. According to Moran, the yoke acts to restrain the motion of the golfer's arms and maintain them in proper relation to the golf club during the swing. This device is not adapted for different body types and sizes. In addition, it appears that use of the device will cause a user's shoulders to move off the swing path at the top of the swing, which can result in the development of a slice, especially for a beginner who does not yet appreciate proper swing technique.

A further device is taught in U.S. Pat. No. 6,458,036 issued to Gutierrez. Gutierrez teaches a golf training device comprising a belt and a flexible strap, the strap being connected at one end to the belt at a position proximal to a golfer's leading hip and at the other end to a distal part of the golfer's leading arm. According to Gutierrez, his device helps a user develop a proper backswing and foreswing. While providing resistance during the top portion of the backswing and a portion of the foreswing, it does not provide guidance throughout the full swing, nor does it provide any guidance with respect to arm placement.

Accordingly, there remains a need for a training device for developing proper swing technique that is easy to use and which is useful throughout the full swing motion.

SUMMARY OF THE INVENTION

The present invention comprises a training device for developing proper swing technique.

According to an embodiment of the invention there is provided a training device for swing development comprising an elongated shaft having a first handle at one end of the shaft and a second handle at the opposite end of the shaft. The first and second handles are rotatably connected to the shaft, extending perpendicularly thereto. The first and second handles extend from the shaft in opposite directions.

The elongated member comprises a coiled spring having a pair of rigid elongated members connected thereto, one rigid member fixedly connected to each end of the spring. Preferably, the rigid elongated members are telescoping and comprise a pair of bars, an inner bar seated within an outer bar, the inner and outer bars adapted to be moved longitudinally in relation to each other and locked into place in a desired position relative to one another.

Each of the inner bars is connected at one end to a respective coupling device, one of the pair of handles being connected to a first coupling device and a second one of the pair of handles being connected to a second coupling device. The coupling devices comprise a rotary bearing and the handles are connected to the rotary bearings of the coupling devices thereby allowing free rotation of the handles within the coupling devices.

The training device described above can be equipped with attachments which are connected to either of the handles, the attachment rotating in conjunction with the rotary movement of the handle within the rotary bearing.

The attachment can be in the form of a brake which provides resistance to rotation of the handle. Alternatively, the attachment can be in the form of a golf club head and modified club shaft.

According to an alternative embodiment of the invention, there is provided a method of controlling a user's golf swing using a training device for swing development, the training device comprising an elongated member having a pair of handles, one handle connected to each end of the elongated member, wherein the handles are rotatably connected to, and extend perpendicular to, the elongated member, the handles extending from the member in opposite directions to one another. The method comprises having a user grasp a first of the pair of handles with one hand and hold it at chest level with the first handle facing outwards from the user's chest. The user grasps a second of the pair of handles with the other hand, the second handle facing towards the user. Holding the first handle in place, the user moves the second handle in a swing pattern.

The foregoing was intended as a broad summary only and of only some of the aspects of the invention. It was not intended to define the limits or requirements of the invention. Other aspects of the invention will be appreciated by reference to the detailed description of the preferred embodiment and to the claims.

BRIEF DESCRIPTION OF THE DRAWINGS

These and other features of the invention will become more apparent from the following description in which reference is made to the appended drawings and wherein.

DETAILED DESCRIPTION OF THE PREFERRED EMBODIMENTS

Figure 1:
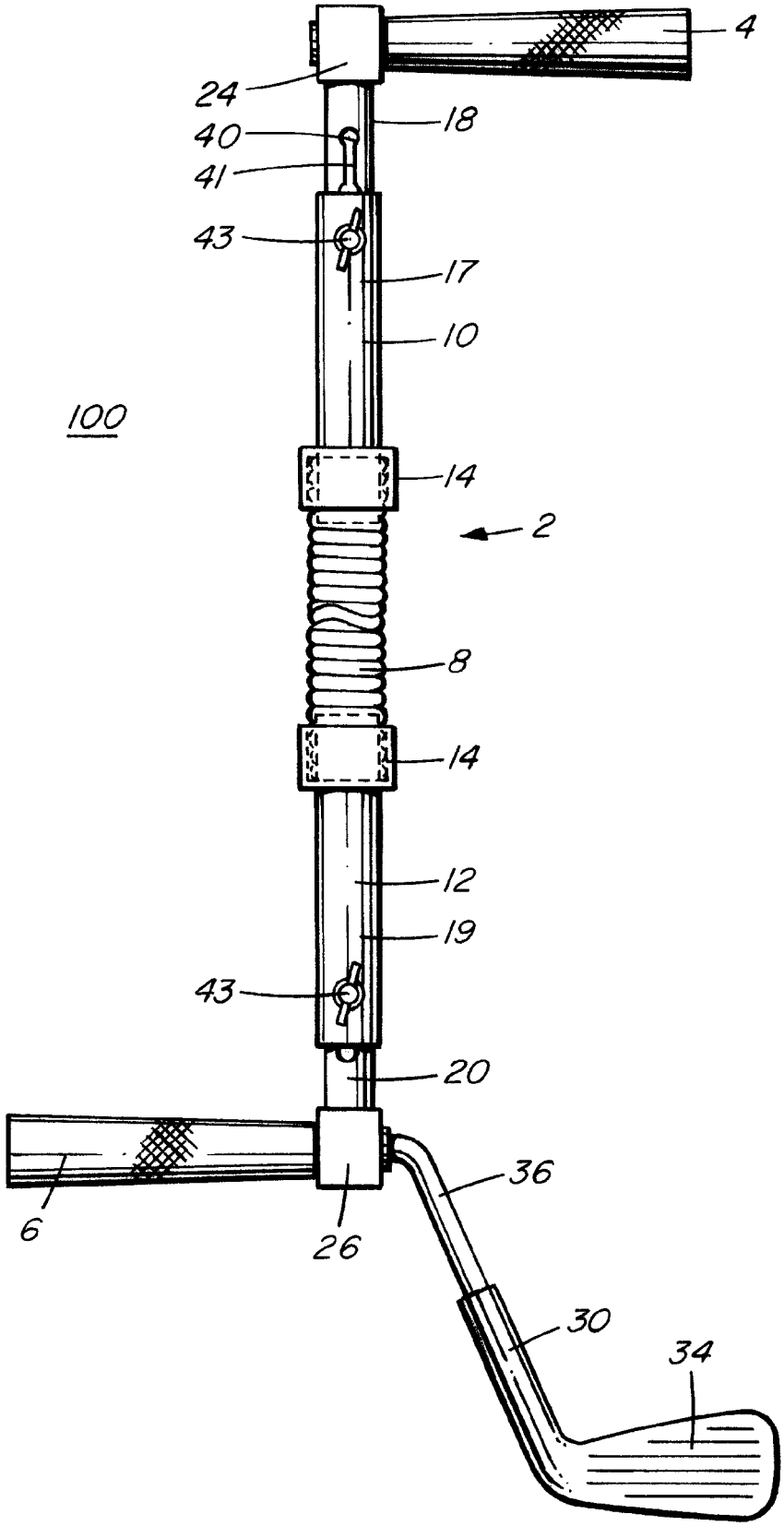
FIG. 1 is a side view of a device according to the preferred embodiment of the invention.

The preferred embodiment of a training device for swing development generally referred to as reference numeral 100 is shown in FIG. 1. Referring to FIG. 1, it can be seen that the training device 100 generally comprises an elongated member 2 having a pair of handles 4, 6 mounted perpendicularly thereto. Handles 4, 6 extend from the elongated member 2 in opposite directions from each other.

Preferably, the elongated member 2 comprises a tightly coiled helical spring 8 and a pair of elongated rigid members 10, 12, one member connected to each end of the spring 8. The rigid members 10, 12 are fixedly connected at one end to the spring 8, preferably by being clamped in place by the spring as described below. A rubber collar 14 or other such covering is positioned over each joint, mainly for cosmetic reasons. Preferably, the rigid members 10, 12 have an outer diameter that is larger than the inner diameter of the spring 8 such that they are connected to the spring by seating an end of each rigid member within the spring. This is accomplished by applying an unwinding force on the spring to cause its diameter to increase a sufficient amount so as to allow the insertion of an end of the rigid member into the spring. Once the rigid member is sufficiently inserted into the spring, the unwinding force on the spring is removed and the spring reforms its original shape, effectively clamping down on the rigid member and holding it fixedly in place. In order to further strengthen the connection between the rigid members 10, 12 and the spring 8, glue may be used. It is also contemplated that the rigid members may be connected to the spring by other methods including, but not limited to, welding or screwing.

Figure 2:
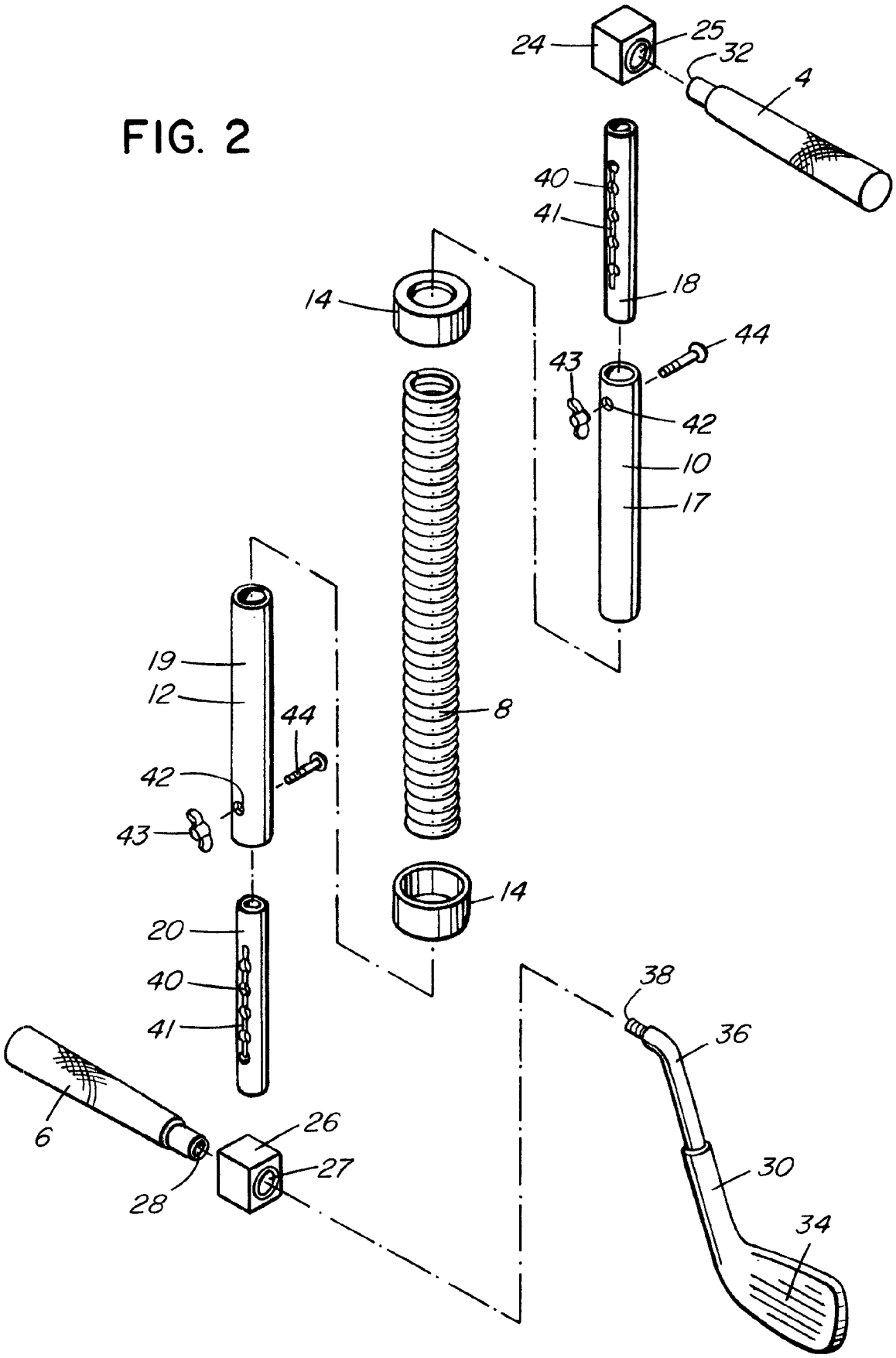
FIG. 2 is a perspective view of the device of FIG. 1.

At their other ends, the elongated rigid members 10, 12 are connected to coupling devices 24 and 26, respectively, preferably by welding. Coupling devices 24 and 26 have rotary bearings within which handles 6 and 4 are rotatably connected, as shown in FIG. 2. The handles 4, 6 are adapted to have attachments, such as a club 30, removably connected thereto. As shown best in FIG. 2, handles 4, 6 preferably have threaded openings 32, 28, respectively, formed in the ends seated within the rotary bearing of coupling devices 26, 24. Club 30 is a modified golf club, comprising the club head 34 and a shortened, modified shaft 36 terminating in a threaded end 38. Threaded end 38 is sized to be threaded into either of the threaded openings 28, 32 so as to connect the club 30 to either handle 6, 4. It is also contemplated that the attachments could be connected to the handles in other ways, such as by snap-fit connections, the only requirements being that the attachment is removably connected and that while connected it is caused to rotate along with the handle.

Figure 3:
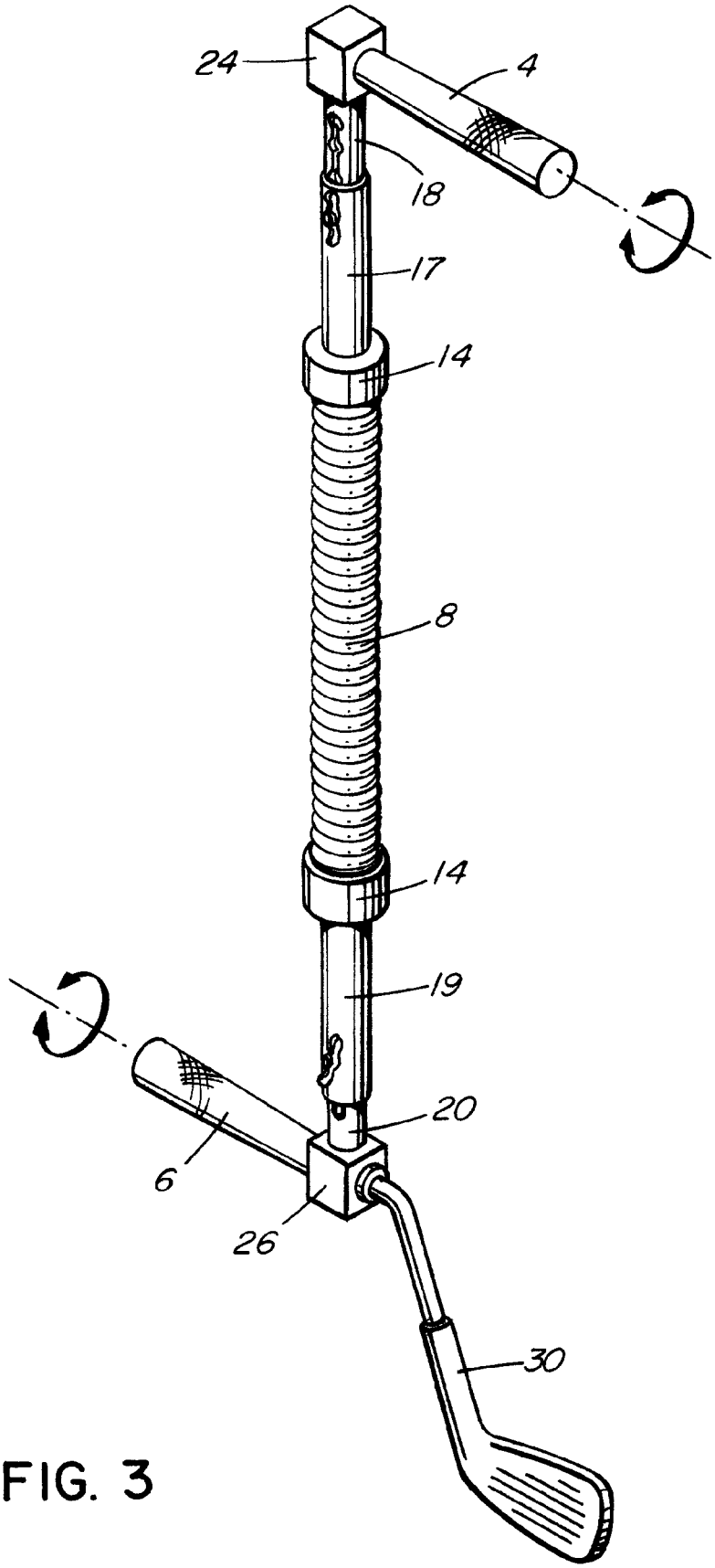
FIG. 3 is an exploded perspective view of the device shown in FIG. 2.

Preferably, the rigid elongated members 10, 12 comprise a pair of telescoping bars 17, 18 and 19, 20, allowing the size of the device 100 to be altered to correspond to the dimensions of the user. Outer bars 17 and 19 are connected to the spring 8 and form an outer sheath within which inner bars 18 and 20 are seated. Bars 18 and 20 are adapted for linear movement within bars 17 and 19 and may be rigidly fixed in a specific position relative to one another. As shown in FIGS. 2 and 3, bars 18 and 20 are equipped with a series of openings 40 spaced longitudinally along the bars, providing different locking points for connection with their corresponding outer bars. Outer bars 18 and 20 each have a single opening 42 disposed laterally therethrough. A threaded bolt 44 is inserted through single opening 42 and a desired point along the series of openings 40 and a nut 43 screwed tightly thereto in order to lock the telescoping bars into place.

In addition to the club attachment 30, which is an iron, other attachments may be connected to the device. It is contemplated that attachments representing each of the different clubs, including woods, irons and putters will be available. Use of these club attachments with the device is especially useful for a beginner as it allows him or her to better understand the relationship between the ball, the club and the swing path each club will take. Use of the device is described in greater detail below. Other attachments for developing strength and endurance or for working on rhythm are also contemplated.

Figure 4:
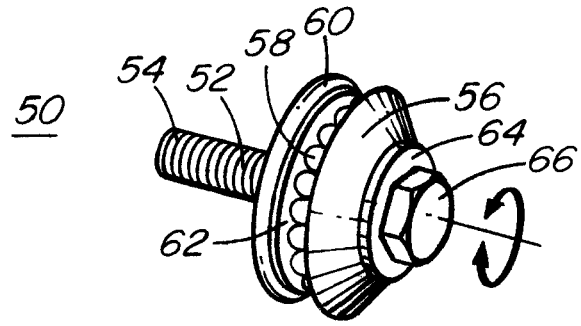
FIG. 4 is a perspective view of a brake attachment for use with the training device of FIG. 1.

An attachment for developing forearm strength and endurance is shown in FIG. 4. Brake 50 is adapted to cause resistance to rotation of the handle when it is connected to it. According to the embodiment shown in FIG. 4, brake 50 comprises a shaft 52 having a threaded portion 54 for connecting to the threaded openings 28, 32 in the handles 6, 4 and a head portion 66 having a larger diameter than shaft 52. A washer 64 is rotatably fitted on the shaft and positioned in abutment with head portion 66. A cylindrical cone 56 is rotatably fitted on the shaft adjacent the washer 64. Cylindrical cone 56 has a concave portion wherein ball bearings 58 are seated. A rubber ring 62 and cylindrical base 60 are rotatably fitted on the shaft and hold the ball bearings 58 in place within the concave portion of cylindrical cone 56. When the brake 50 is connected to the handle, the base 60, rubber ring 62, ball bearings 58, cylindrical cone 56 and washer 64 are compressed together between the coupling device and the head portion 66. This compression causes the ball bearings 58 to compress into the rubber ring 62 limiting their movement. When attached, the brake acts to resist rotation of the handle, thereby increasing the user's wrist, shoulder and arm strength. Tightening the connection between the handle and the brake increases the resistance to rotation.

It is also contemplated that other attachments could be developed such as a screw on counter for training swing rhythm. While not shown, the screw on counter is adapted to make a periodic noise, either at a pre-set time interval, at a given point in the swing (for example, the top and bottom), or once the handle has been rotated a given amount. This audible signal provides a user with a useful tool to work on the rhythm of their swing. This is useful in developing a smooth swing and working on timing.

Figure 5:
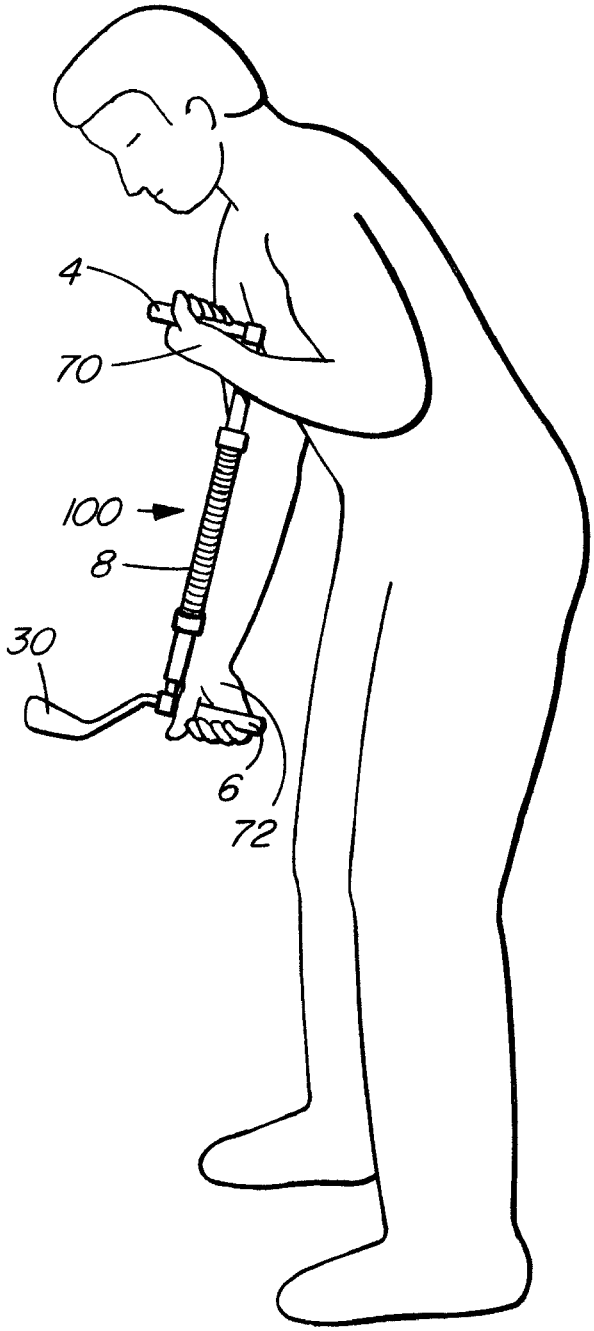
FIG. 5 is a side view of a golfer using an embodiment of the invention.

Use of the device will now be described with reference to FIG. 5. With one hand 70, a user grasps a first handle 4 of the device 100 and holds it a chest level along the 30 centerline of the person's body. The device is held with the handle facing away from the user's chest. With the other hand 72, the user grasps the second handle 6, this handle facing towards the user's body. In FIG. 5, the user is shown having grasped the first handle 4 with their left hand 70 and holding the second handle 6 in their right hand 72. The left hand 70 is shown with the palm facing up; however it is also contemplated that the handle could be gripped with the palm facing down. From the lowered, resting position shown in FIG. 5, the user draws back their right hand 72 so as to complete a golf backswing to the end of the range of motion, while maintaining the first handle centered at chest level. Once at the top of the swing, the user commences a fore swing until the end of the range of motion. This exercise is repeated with the arms in the opposite position in order to practice the follow through portion of the swing. Because the club attachment rotates with the handle, the user is provided with a visible example of what effect wrist motion has on the presentation of the club face to the ball. It is also contemplated that other swing exercises can be performed using the device 100.

Using the device 100 allows a user to understand how to address the golf ball properly. This includes teaching proper stance, posture, grip and right and left hand actions through the range of motion of a swing. It conditions the user's body to remain stable for repeat solid contact with the golf ball. The device also acts to strengthen the muscles used to swing the club and to train them how and when to work during the swing, thus creating muscle memory. In addition, the added conditioning provided by exercising with the device means that the user's swing will remain strong for a longer period of time, thereby avoiding breakdowns in technique brought on by muscle fatigue in the later stages of a game.

In addition to providing additional weight to the device, the spring can be used for strength training for a user's inner arm muscles. These muscles are important for proper swing mechanics. The user grasps the device 100 at either end (where the handles are connected to the elongated member) and attempts to fold the ends towards one another, a movement which is resisted by the spring. The springs can come in a variety of sizes providing additional weight and resistance for stronger users of the device.

While the device 100 has been described for use with golf, it is also contemplated that it can be used to develop other swings, such as tennis, squash, baseball, etc. Attachments in the form of racket heads, bat extensions or the like could be connected to the device to provide a visual representation of the sporting equipment to be swung so as to better teach a user the fundamentals of swing technique.

It will be appreciated by those skilled in the art that the preferred and alternative embodiments have been described in some detail but that certain modifications may be practiced without departing from the principles of the invention.

What is claimed is:

1. A training device for swing development comprising:

an elongated member having a pair of handles, one handle connected to each end of the elongated member, wherein said handles are rotatably connected to, and extend perpendicular to, said elongated member, said handles extending from said member in opposite directions to one another;

said elongated member comprises a coiled spring having a pair of telescoping rigid elongated members connected thereto, one rigid elongated member fixedly connected to each end of said spring;

wherein each of said pair of telescoping rigid elongated members comprises a pair of bars, an inner bar seated within an outer bar, said inner and outer bars adapted to be moved longitudinally in relation to each other and locked into place in a desired position relative to one another, a first said inner bar being connected at one end to a first coupling device and a second said inner bar being connected at one end to a second coupling device, one of said pair of handles being connected to said first coupling device and a second one of said pair of handles being connected to said second coupling device;

each of said first and second coupling devices comprises a rotary bearing, said handles being connected to said rotary bearings of said coupling devices allowing free rotation of said handles within said coupling devices; and an attachment connected to said handle, said attachment rotating in conjunction with the rotary movement of the handle.

2. The training device of claim 1 wherein said attachment provides resistance to rotation of said handle.

3. The training device of claim 2 wherein said attachment comprises a brake having a threaded shaft and a head portion and resistance means compressed between said head portion and said coupling device when said attachment is connected thereto.

4. The training device of claim 1 wherein said attachment comprises a golf club head and modified club shaft.

* * * * *